US005794458A

United States Patent [19]

Naumovitz et al.

[11] Patent Number: 5,794,458

[45] Date of Patent: Aug. 18, 1998

[54] METHOD AND APPARATUS FOR PRODUCING GASEOUS OXYGEN

[75] Inventors: Joseph P. Naumovitz, Lebanon; Joseph Straub, North Haledon; Leighton B. Wilson, North Plainfield, all of N.J.

[73] Assignee: The BOC Group, Inc., New Providence, N.J.

[21] Appl. No.: 790,834

[22] Filed: Jan. 30, 1997

[51] Int. Cl.[6] ..... F25J 3/04

[52] U.S. Cl. ..... 62/647; 62/651; 62/654; 62/901

[58] Field of Search ..... 62/647, 649, 650, 62/651, 654, 901

[56] References Cited

U.S. PATENT DOCUMENTS

| | | | |
|---|---|---|---|
| 3,500,651 | 3/1970 | Becker | 62/654 X |
| 3,736,762 | 6/1973 | Toyama et al. | 62/649 |
| 4,133,662 | 1/1979 | Wagner | 62/650 |
| 4,783,210 | 11/1988 | Ayers et al. | 62/651 |
| 4,834,785 | 5/1989 | Ayres | 62/650 |
| 5,289,688 | 3/1994 | Agrawal | 62/651 |
| 5,303,556 | 4/1994 | Dray et al. | 62/901 X |
| 5,325,674 | 7/1994 | Gastinne et al. | 62/901 X |
| 5,442,925 | 8/1995 | Agrawal et al. | 62/651 |
| 5,507,148 | 4/1996 | Mostello | 62/651 |

*Primary Examiner*—Christopher Kilner

*Attorney, Agent, or Firm*—David M. Rosenblum; Salvatore P. Pace

[57] ABSTRACT

A method and apparatus for making gaseous oxygen at a delivery pressure in a single column oxygen generator. In accordance with the method and apparatus, a column bottoms stream composed of the product is pumped to the delivery pressure and then vaporized. A liquid coolant stream used in condensing reflux is recompressed by a recycle compressor and then recycled back into the bottom of the column. Such recycled stream has a higher nitrogen content than the column bottoms. Part of the nitrogen tower overhead, not used in forming the reflux, is turbo-expanded by a turbo-expander coupled to the recycle compressor.

10 Claims, 1 Drawing Sheet

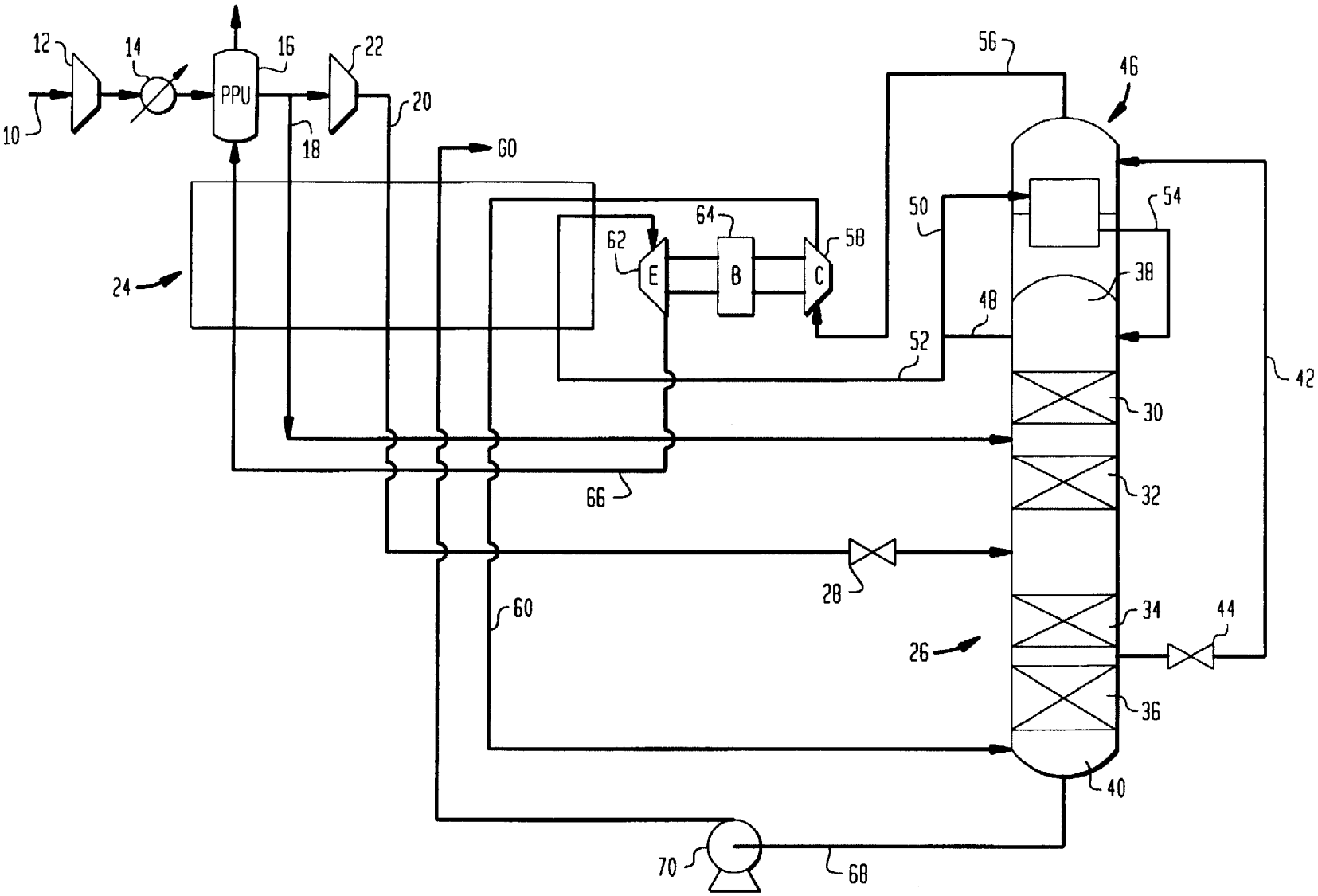
42
44
54
38
30
32
34
36
46
40
56
48
50
52
26
28
58
C
B
64
E
62
66
68
70
60
60
20
22
18
16
PPU
14
24
12
10

METHOD AND APPARATUS FOR PRODUCING GASEOUS OXYGEN

BACKGROUND OF THE INVENTION

The present invention relates to a method and apparatus for producing gaseous oxygen in which liquid oxygen, produced as column bottoms in a single column oxygen generator, is pumped to a delivery pressure and then vaporized. More particularly, the present invention relates to such a method and apparatus in which a coolant stream used in condensing reflux for the single column oxygen generator is recompressed and reintroduced back into the column and part of a nitrogen rich stream, composed of tower overhead is expanded to supply plant refrigeration and to power the recompression.

Oxygen is produced in a double column air separation unit having higher and lower pressure columns. The higher pressure column produces crude liquid oxygen as a column bottoms. The crude liquid oxygen is further refined in the lower pressure column to produce the liquid oxygen. The liquid oxygen, advantageously, can then be pumped to a delivery pressure and then vaporized within a main heat exchanger or a separate vaporizer. Pumping is advantageous in that the liquid stream can be pressurized to virtually any delivery pressure without utilization of large scale oxygen compressors. The implementation of such compressors is particularly costly and the compression of oxygen presents issues of plant safety.

As an alternative to the double column process, U.S. Pat. No. 4,357,153 discloses a single column process for producing oxygen. The advantage of a single column is that fabrication costs are reduced over double column units. However, the use of such a single column oxygen generator is generally not as efficient as double column units. In this patent, however, an attempt is made to increase the efficiency of the single column oxygen generator through utilization of a heat pump cycle in which the column bottoms, which is made up of the oxygen product, is used as a coolant in a head condenser of the column. The resulting vaporized oxygen is in part compressed in a recycle compressor at a temperature about equal to the cold side of the main heat exchanger and then reintroduced into the bottom of that column. At the same time, part of the tower overhead that is not condensed is partly heated, turbo-expanded and then discharged from the process. The turbo-expander can be coupled to the recycle compressor in order to help minimize the energy outlay involved in such recompression. The problem with the type of cycle disclosed in such patent is that all the oxygen is not taken as a product. Additionally, if the oxygen product that is taken were required at a higher pressure, it would have to be compressed by a large scale oxygen compressor.

Heat pump cycles have also been employed in single column nitrogen generators such as that disclosed in U.S. Pat. No. 5, 582,034. In this patent, a greater cyclical efficiency is realized by circulating a coolant stream having a higher nitrogen content than the column bottoms. Preferably, such higher nitrogen content would have a stream composition being close to the equilibrium vapor composition of the sump liquid in the column. In a nitrogen generator, the sump liquid would have the concentration of about 55% oxygen. For this reason, the column bottoms, also known as waste, is turbo-expanded to generate refrigeration and then discharged from the process as waste. Hence, heat pump cycle teachings, in so far as they relate to nitrogen generators, are not completely applicable to single column oxygen generators in that the column bottoms is produced as waste rather than as a desired product.

As will be discussed, the present invention provides an oxygen generator producing pressurized liquid oxygen at efficiencies that exceed those of double column units.

SUMMARY OF THE INVENTION

The present invention provides a method of making gaseous oxygen. In accordance with the method a compressed and purified air stream is formed. The compressed and purified air stream is fully cooled and then rectified within a single column oxygen generator to produce a gaseous nitrogen rich tower overhead and a liquid oxygen rich column bottoms at top and bottom regions thereof. A liquid coolant stream is extracted from the single column oxygen generator and then valve expanded. The liquid coolant stream has a nitrogen content greater than the liquid oxygen enriched column bottoms. A tower overhead stream is withdrawn and divided into first and second subsidiary streams. The first subsidiary stream is condensed against vaporizing the coolant stream to produce a vaporized coolant stream and reflux for the column. The second subsidiary stream is partially heated and expanded with a performance of work to form a refrigerant stream. The refrigerant stream is fully warmed. The vaporized coolant stream is compressed, fully cooled and then reintroduced back into the single column oxygen generator. Part of the work generated by expanding the second subsidiary stream is utilized to compress the vaporized coolant stream. A column bottom stream is extracted, pumped to a pressure and then used to form the gaseous oxygen. It is understood that such pressure may be a delivery pressure or may be less than delivery pressure. In such case an oxygen compressor would be used to raise pressure to the delivery pressure.

In another aspect, the present invention provides an apparatus for making gaseous oxygen. In accordance with this aspect of the invention, a means is provided for compressing and purifying an air stream to form a compressed and purified air stream. A single column oxygen generator is provided for rectifying the compressed and purified air stream after having been fully cooled. As a result of such rectification, a gaseous nitrogen rich tower overhead and a liquid oxygen rich column bottoms are produced in top and bottom regions thereof, respectively.

A head condenser is connected to the single column oxygen generator to receive a liquid coolant stream having a greater nitrogen content than the liquid oxygen rich column bottoms and a part of the tower overhead stream originating from the top region of the single column oxygen generator. The head condenser is configured such that the coolant stream vaporizes to form a vaporized coolant stream against condensing the part of the tower overhead stream. An expansion valve is interposed between the single column oxygen generator and the head condenser for valve expanding the liquid coolant stream. A recycle compressor is connected to the head condenser for recompressing the vaporized coolant stream. A pump is provided for pumping a column bottom stream composed of the oxygen enriched liquid column bottoms to a pressure.

A main heat exchange means is connected to the recycle compressor and the single column oxygen generator. The main heat exchange means is configured for fully cooling the compressed and purified air stream prior to being rectified and the vaporized coolant stream after having been recompressed, for partly warming a remaining part of the tower overhead stream and for fully warming a refrigerant stream. An expansion means is connected to the main heat exchange means for expanding the second subsidiary stream with the performance of work, after the second subsidiary stream is partly warmed, thereby to form the refrigerant stream. The main heat exchange means is also connected to the single column oxygen generator so that the vaporized coolant stream, after compression, is reintroduced back into the single column oxygen generator after having been fully cooled.

A means is provided for coupling the expansion means and the recycle compressor so that the work produced by expansion is employed in part in powering the recycled compressor. Additionally, a means is connected to the pump and uses the column bottoms stream, after having been pumped, for forming the gaseous oxygen.

The method and apparatus of the present invention advantageously allows for the pumping of liquid oxygen produced as a column bottoms to a pressure which can be delivery pressure. Thus, no large scale oxygen compressor is utilized. In fact all of the product oxygen is pumped to the delivery pressure in the subject invention. Since it is the column bottoms that is being pumped, a liquid coolant stream having a greater nitrogen content can be used as a coolant for the head condenser. After having been vaporized, such coolant can be returned to the column in order to increase recovery. Preferably, such stream is a composition that will be in vapor equilibrium with the column bottoms. This will increase the efficiency of the bottom of the column beneath the air feed. At the same time, since the liquid stream has a greater nitrogen content than the column bottoms, it will have the greater dew point pressure upon vaporization. As a result, such stream need not be recompressed to the same extent that would be required for a column bottoms stream.

As used herein and in the claims, the term "fully warmed" means warmed to the condition existing at the warm side of the main heat exchanger. "Fully cooled" means cooled to the cold end of the main heat exchanger. The term "partly warmed" means warmed to a temperature between the warm and cold ends of the main heat exchanger.

BRIEF DESCRIPTION OF THE DRAWINGS

While the present invention concludes with claims distinctly pointing out the subject matter that Applicants regard as their invention, it is believed that the invention will be better understood when taken in connection with the accompanying drawing in which the sole figure is a schematic view of an apparatus for carrying out a method in accordance with the present invention.

DETAILED DESCRIPTION

With reference to the figure, an air stream 10 after having been filtered is compressed in a compressor 12. After heat of compression is removed by an after-cooler unit 14, the resultant compressed stream is then purified of heavy contaminants such as carbon dioxide, moisture and hydrocarbons by a prepurification unit 16. Prepurification unit 16 can be a multiple bed unit, known in the art, employing activated alumina as an absorbent. The resultant compressed and purified air stream can be divided into first and second compressed and purified air streams 18 and 20. Second compressed and purified air stream 20 has a greater pressure than first compressed and purified air stream 18 by virtue of it being further compressed in a booster compressor 22. It is understood, first and second compressed and purified air streams could be separately formed. Moreover, embodiments of the present invention are also possible in which a only one compressed and purified air stream is used.

First and second compressed and purified air streams 18 and 20 are then fully cooled in a main heat exchanger 24. In this regard, second compressed and purified air stream may be liquefied. Main heat exchanger 24 can be either a single unit or a complex of heat exchangers of known construction.

First and second compressed and purified air streams 18 and 20 are introduced into appropriate locations of a single column oxygen generator 26. Second compressed and purified air steam is valve expanded to column pressure by way of an expansion valve 28. Single column oxygen generator has liquid vapor contacting elements 30, 32, 34 and 36 which can be trays or packings (either random or structured).

Single column oxygen generator 26 acts to rectify the incoming air in order to produce a nitrogen rich tower overhead within a top region 38 and a liquid oxygen enriched column bottoms in a bottom region 40 thereof. A coolant stream 42 is extracted from single column oxygen generator 26 and then is valve expanded by an expansion valve 44 to a temperature that will be suitable for condensing reflux. The reflux will in part consist of nitrogen rich tower overhead. To this end, a head condenser 46 is attached to top region 38 of single column oxygen generator 26. A tower overhead stream 48 originating from top region 38 of single column oxygen generator 26 is divided into first and second subsidiary streams 50 and 52. Head condenser 46 receives liquid coolant stream 42 and vaporizes it against condensing first subsidiary stream 50. Such condensation produces a reflux stream 54 which is reintroduced back into top region 38 and a vaporized coolant stream 56. Vaporized coolant stream 56 is recompressed to column pressure by a recycle compressor 58 and is then reintroduced as a compressed stream 60 back into bottom region 40 of single column oxygen generator 26.

As mentioned previously, liquid coolant stream 42 is preferably selected to have a composition that will approach vapor equilibrium with the liquid oxygen enriched column bottoms or sump liquid contained within bottom region 40 of single column oxygen generator 26. Preferably the process will be conducted so that liquid coolant stream 42 contains approximately a 10% increase in the nitrogen content as compared to the liquid oxygen enriched column bottoms. In any event, the process should be conducted so that liquid coolant stream 42 has a nitrogen content that is no less than about 2% greater than the column liquid oxygen enriched bottoms of bottom region 40.

Second subsidiary stream 52 after having been partly warmed within main heat exchanger 24, is expanded within, preferably, a turbo-expander 62 which is coupled to recycle compressor 58. Excess energy of expansion is dissipated by an energy dissipative brake 64, a generator or other known energy dissipation devices. As a result of such expansion, a refrigerant stream 66 is produced which is fully warmed within main heat exchanger 24. Refrigerant stream 66 can be taken as a low pressure product, can be compressed back to a delivery pressure, or as illustrated can be used in a manner known in the art to help regenerate absorbent beds contained within prepurification unit 16.

Gaseous oxygen is produced by extracting a column bottoms stream 68 from bottom region 40 of single column oxygen generator 26. Column bottoms stream 68 is pumped by a pump 70 and then fully warmed within main heat exchanger 24 to produce the gaseous oxygen product (designated as "GO".)

As can be appreciated by those skilled in the art, other means can be used in forming the gaseous oxygen product.

For instance, it is possible to vaporize column bottoms stream 68 in a separate vaporizer. Additionally, it is also possible to utilize the column bottoms stream in an indirect manner to form the gaseous oxygen product. Such indirect usage would include introducing column bottoms stream 68 into a mixing column associated with single column oxygen generator 36. In such case, column bottoms stream 68, after pumping to the desired delivery pressure, would be introduced into the top of such mixing column to enter into mass transfer with compressed air that could be boosted in pressure by a booster compressor if necessary. A gaseous oxygen product would be formed from mixing column tower overhead. Column bottoms from the mixing column would be introduced into an appropriate point of single column oxygen generator 36.

Although the apparatus described above (including possible alternative embodiments) uses boosted compressed air as a second compressed and purified air stream 20, as would occur to those skilled in the art, other embodiments of the present invention could be designed to have all of the air compressed and used at one pressure. For instance, a single air stream could be sufficiently compressed to vaporize a pumped column bottoms stream directly in the main heat exchanger or in a separate vaporizer. Alternatively, part of such single air stream could be used in a mixing column.

The alternate possible embodiments, discussed above, are meant to be included in the subject invention as set forth in the appended claims. In this regard, while the present invention has been described with reference to preferred and alternative embodiments, as will occur to those skilled in the art, numerous other additions, changes and omissions may be made without departing from the spirit and scope of the present invention.

We claim:

1. A method of making gaseous oxygen comprising:

forming a compressed and purified air stream;

fully cooling and then rectifying said compressed and purified air stream in a single column oxygen generator to produce a gaseous nitrogen rich tower overhead and a liquid oxygen rich column bottoms in top and bottom regions thereof, respectively;

extracting from said oxygen generator and valve expanding a liquid coolant stream having a nitrogen content greater than said liquid oxygen rich column bottoms;

withdrawing a tower overhead stream and dividing said tower overhead stream into first and second subsidiary streams;

condensing said first subsidiary stream against vaporizing said coolant stream to produce a vaporized coolant stream and column reflux;

partially heating said second subsidiary stream, expanding said second subsidiary stream with performance of work to form a refrigerant stream, and fully warming said refrigerant stream;

compressing said vaporized coolant stream, fully cooling said vaporized coolant stream, and reintroducing said vaporized coolant stream back into said single column oxygen generator;

using part of said work generated by expanding said second subsidiary stream to compress said vaporized coolant stream;

extracting a column bottoms stream, pumping said column bottoms stream to a pressure; and using said column bottoms stream to form said gaseous oxygen.

2. The method of claim 1, wherein:

said compressed and purified air stream is a first compressed and purified air stream;

a second compressed and purified air stream is formed so as to have a higher pressure than said first compressed and purified air stream;

said second compressed and purified air stream is also fully cooled, pressure reduced to column pressure and then introduced into said single column oxygen generator.

3. The method of claim 2, wherein said refrigerant stream fully warms, said second subsidiary stream partly warms, and said column bottoms stream vaporizes through indirect heat exchange with said first and second compressed and purified air streams.

4. The method of claim 1, wherein said vaporized coolant stream is compressed at about a rectification temperature at which said rectification is conducted.

5. The method of claim 1, wherein said column bottoms is directly formed into a product stream containing said pressurized oxygen.

6. The method of claim 2, wherein said second compressed and purified air stream is liquefied by said indirect heat exchange.

7. An apparatus for making gaseous oxygen at a delivery pressure comprising:

means for compressing and purifying air to form compressed and purified air stream;

a single column oxygen generator for rectifying said compressed and purified air stream, after having been fully cooled, to produce a gaseous nitrogen rich tower overhead and a liquid oxygen rich column bottoms in top and bottom regions thereof, respectively;

a head condenser connected to said single column oxygen generator to receive a liquid coolant stream having a greater nitrogen content than said liquid oxygen rich column bottoms and part of a tower overhead stream originating from said top region of said single column oxygen generator;

said head condenser configured such that said coolant stream vaporizes to form a vaporized coolant stream against condensing the part of the tower overhead stream to form column reflux;

an expansion valve interposed between said single column oxygen generator and said head condenser for valve expanding said liquid coolant stream;

a recycle compressor connected to said head condenser for recompressing said vaporized coolant stream;

a pump for pumping a column bottoms stream composed of said oxygen rich liquid column bottoms to a pressure;

main heat exchange means connected to said recycle compressor and said single column oxygen generator and configured for fully cooling said compressed and purified air stream, prior to being rectified and said vaporized coolant stream after having been recompressed, for partly warming a remaining part of said tower overhead stream and for fully warming a refrigerant stream;

expansion means connected to said main heat exchange means for expanding said second subsidiary stream with performance of work after said second subsidiary stream has partially warmed, thereby to form said refrigerant stream;

said main heat exchange means also connected to said single column oxygen generator so that said vaporized coolant stream is reintroduced back into said single column oxygen generator after having been fully cooled;

means for coupling said expansion means and said recycle compressor so that said work produced by expansion is employed in part in powering said recycle compressor; and means connected to said pump and using said column bottoms stream, after having been pumped, for forming said gaseous oxygen.

8. The apparatus of claim 1, wherein:

said compressed and purified air stream is a first compressed and purified air stream;

a booster compressor is also connected to said main heat exchange means to form a second compressed and purified air stream at a pressure greater than that of said first compressed and purified air stream;

said mean heat exchange means is also configured for fully cooling said second compressed and purified air stream and is connected to said single column oxygen generator so that said second compressed and purified air stream is introduced into said single column oxygen generator; and another expansion valve is interposed between said main heat exchange means and said single column oxygen generator to pressure reduce said second compressed and purified air stream to column pressure.

9. The apparatus of claim 7 or claim 8, wherein:

said pump is connected to said main heat exchange means and said gaseous oxygen forming means comprises said main heat exchange means configured to fully warm and therefore vaporize said column bottoms stream.

10. The apparatus of claim 7, wherein said recycle compressor is directly interposed between said single column oxygen generator and said main heat exchange means so that said vaporized coolant stream is compressed at about a rectification temperature at which said rectification is conducted.

* * * * *